US009744773B2

(12) United States Patent
Anderson

(10) Patent No.: US 9,744,773 B2
(45) Date of Patent: Aug. 29, 2017

(54) DETECTING INK CHARACTERISTICS

(71) Applicant: HEWLETT-PACKARD DEVELOPMENT COMPANY, L.P., Houston, TX (US)

(72) Inventor: Daryl E Anderson, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/300,662

(22) PCT Filed: Apr. 22, 2014

(86) PCT No.: PCT/US2014/034887
§ 371 (c)(1),
(2) Date: Sep. 29, 2016

(87) PCT Pub. No.: WO2015/163849
PCT Pub. Date: Oct. 29, 2015

(65) Prior Publication Data

US 2017/0120620 A1 May 4, 2017

(51) Int. Cl.
*B41J 29/38* (2006.01)
*B41J 2/195* (2006.01)

(52) U.S. Cl.
CPC ..... *B41J 2/195* (2013.01)

(58) Field of Classification Search
CPC ..... B41J 2/04588; B41J 29/393; B41J 2/195
(Continued)

(56) References Cited

U.S. PATENT DOCUMENTS 4,085,408 A * 4/1978 Muto ..... B41J 2/03 347/6
5,682,184 A 10/1997 Stephany et al.
(Continued)

FOREIGN PATENT DOCUMENTS

JP 201-1-008742 A 1/2014
KR 10-2002-0062506 7/2002
(Continued)

OTHER PUBLICATIONS

Rianasari. Ina. Inkjet Structuring on Electrode Surfaces. Oct. 2010.

*Primary Examiner* — Jannelle M Lebron
(74) *Attorney, Agent, or Firm* — HP Inc.—Patent Department

(57) ABSTRACT

A method for determining characteristics of an ink is described. The method includes subjecting the ink of an inkjet printing system to an alternating signal of a first frequency to generate response signals from the ink, where the response signals include at least a response voltage signal and a response current signal. The method further includes comparing the response voltage signal to a predetermined voltage threshold, to generate a voltage phase signal, and comparing the response current signal to a predetermined current threshold, to generate a current phase signal. The method also includes tuning at least one of the predetermined voltage threshold and the predetermined current threshold to determine a balance point, and identifying a first relative phase difference between the voltage phase signal and the current phase signal, where the first relative phase difference is indicative of characteristics of the ink corresponding to the first frequency.

15 Claims, 5 Drawing Sheets

(58) Field of Classification Search
USPC ..... 347/6, 9–11, 14, 100
See application file for complete search history.

(56) References Cited

U.S. PATENT DOCUMENTS

| | | | | |
|---|---|---|---|---|
| 6,431,670 | B1 | 8/2002 | Schantz et al. | |
| 2005/0024396 | A1 | 2/2005 | Farr | |
| 2006/0265150 | A1 | 11/2006 | Hu et al. | |
| 2011/0043556 | A1 | 2/2011 | Huime et al. | |
| 2013/0050308 | A1* | 2/2013 | Asauchi ..... | B41J 2/17513 347/6 |

FOREIGN PATENT DOCUMENTS

| | | |
|---|---|---|
| KR | 10-2005-0004505 | 1/2005 |
| WO | WO2013062513 | 5/2013 |

* cited by examiner

DETECTING INK CHARACTERISTICS

BACKGROUND

Inkjet printing involves releasing ink onto a print medium, such as paper. The ink bonds with the print medium to produce visual representations of texts, images or any other graphical content, onto the print medium. Inkjet printers generally include print heads which are configured to release small bursts of the ink from extremely fine nozzles. To a large extent the configuration of such inkjet printers, such as amount of ink to be released and manner in which the ink is to be released, is based on the characteristics of ink being used. An inkjet printer generally provides optimum performance when used with an ink for which it has been configured.

BRIEF DESCRIPTION OF DRAWINGS

The detailed description is provided with reference to the accompanying figures. In the figures, the left-most digit(s) of a reference number identifies the figure in which the reference number first appears. The same numbers are used throughout the drawings to reference like features and components.

DETAILED DESCRIPTION

Figure 1:
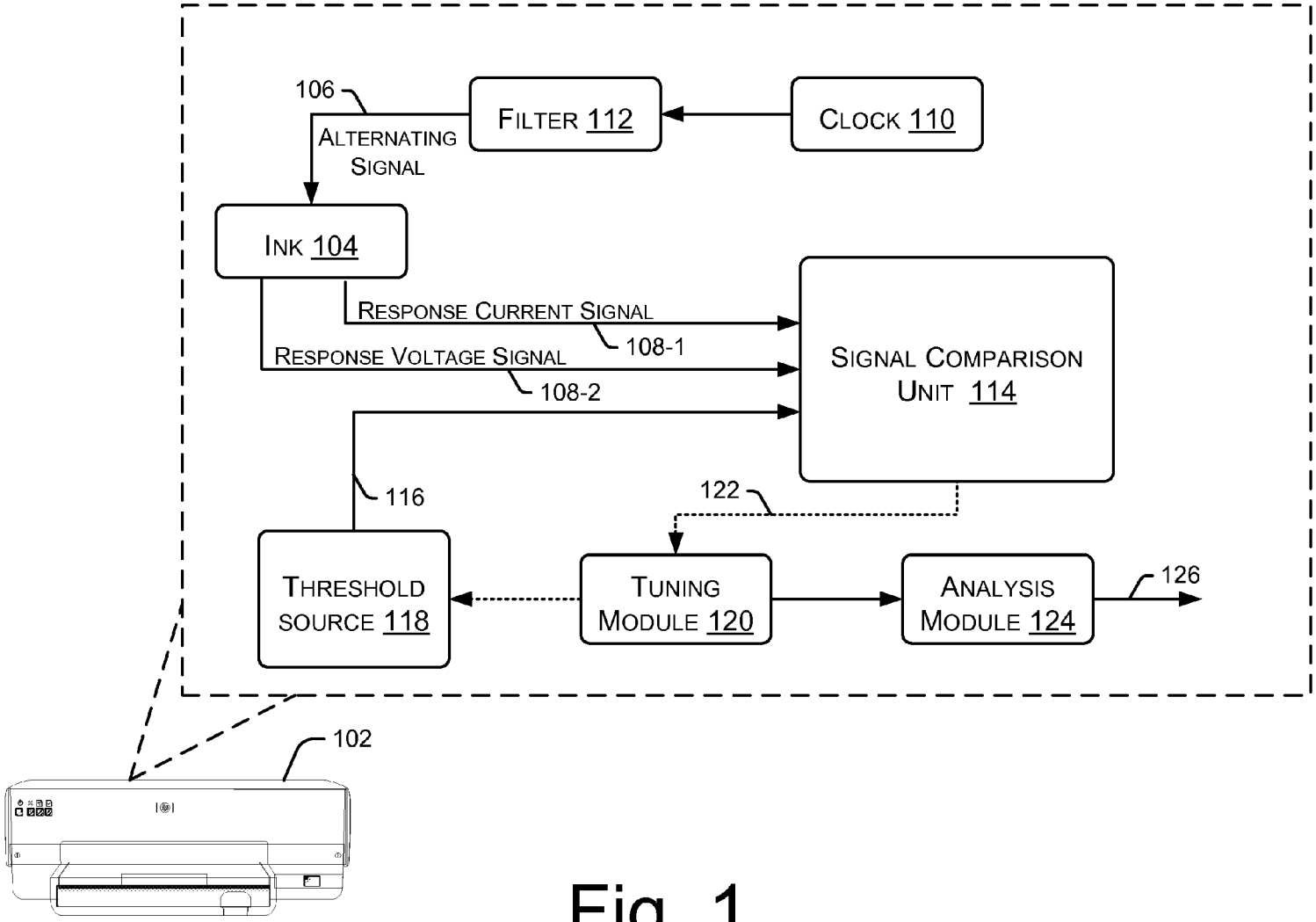
FIG. 1 illustrates an inkjet printing system for detecting ink characteristics, according to an example of the present subject matter.

Over a period of time and use, ink of the inkjet printing systems may get destabilized, such as the ink may get dehydrated, or achieve pigment saturation. The use of the inkjet printing system while the ink has destabilized may either result in poor quality of printing, or may even damage the components of the inkjet printing system. Further, the ink used by the inkjet printing systems may even get exhausted over a period of time and use. In such situations, an ink reservoir coupled to the print head, used to hold the ink, may have to be either refilled with more ink, or may be replaced with new ink. For the optimum performance of the inkjet printer, it should be ensured that the ink refilled or replaced has characteristics similar to the ink for which the inkjet printer is configured for. Deviation in ink characteristics may either cause deviations in quality of printing, or may even cause damage to the components of the inkjet printing system.

Therefore, either due to destabilization of the original ink, or due to replacement of the ink with ink of different characteristics, the components of the inkjet printing system may malfunction, and may even undergo permanent damage. Ink characteristics may be analyzed by using electrochemical impedance spectroscopy (EIS). The implementation of EIS generally involves usage of extensive electronics which when implemented on the print head utilizes significant chip area, thereby proliferating the cost of the inkjet printing systems. Specifically, the physical size of a sine wave generator utilized in the EIS method consumes a large amount of chip area and, providing the sine wave generator on inkjet printing systems not only incurs more cost, but also makes the inkjet printing systems more bulky and heavy.

Further, the analysis of signals generated by the ink in EIS method is dependent on the conversion of such signals from analog values to digital values. To evaluate the signals in digital form, Analog to Digital signal converters (ADCs) may have to convert up to 50 mega samples per second, but providing ADCs with such capabilities is generally not possible on portable inkjet printing systems due to processing constraints. Also, to analyze the high frequency signals within the inkjet printing system, a high frequency connection is to be provided between the print head and the components of the inkjet printing system. Providing such high frequency connection again involves high cost.

Therefore, the analysis of the ink within the inkjet printing systems, and specifically at the print head of the inkjet printing systems, may utilize complex circuitry and might be intensive in terms of both space and cost, thereby rendering the method of EIS inefficient to analyze the characteristics of the ink within the inkjet printing systems.

According to an example of the present subject matter, systems and methods for detecting ink characteristics on an inkjet printing system are described. The described systems and methods may provide cost effective ways of analyzing the ink within the inkjet printing systems such that the analysis of the ink is performed on the inkjet printing system to determine the characteristics of the ink. Also, the implementation of the described systems and methods may allow identification of health of the ink based on the analysis.

In an example of the present subject matter, an inkjet printing system may analyze inks by applying electrical signals of various frequencies to the ink. The ink may cause generation of response signals which may then be recorded and analyzed to determined characteristics of the ink. In operation, the electric signals may be alternating signals comprising of either alternating current signal, or alternating voltage signal. For the purpose of explanation, the alternating current signal, or alternating voltage signal have been commonly referred to as alternating signals hereinafter. In one example, different alternating signals of different frequencies may be generated by the inkjet printing system for the purpose of determining the characteristics of the ink.

The ink when subjected to an alternating signal of a particular frequency, say first frequency, may generate response signals. The response signals may include a response voltage signal and a response current signal. For the sake of explanation, the response voltage signal and a response current signal have been commonly referred to as response signals. The inkjet printing system may compare the response signals to predetermined thresholds. In one example, the inkjet printing system may use analog comparing units, such as comparators to analyze the analog response signals and thereby eliminate the use of an ADC convertor for the purpose of analysis. It would be appreciated that electric components other than the comparator may also be utilized within the inkjet printing system to compare the analog response signals to predetermined thresholds.

In said example, the response voltage signal may be compared to a predetermined voltage threshold, by the comparator, to generate a voltage phase signal, and the response current signal may be compared with a predetermined current threshold, by the comparator, to generate a current phase signal. The voltage phase signal and the current phase signal non-synchronously change their phase from time to time since a relative phase difference exists between the response voltage signal and the response current signal.

In one example of the present subject matter, either of the predetermined voltage threshold or the predetermined current threshold may be tuned to achieve a balance point. The balance point can be understood as the instance at which the voltage phase signal and the current phase signal concurrently transitions from a logical 'low' to a logical 'high'. It would be appreciated that the logical 'high' may represent any value of current or voltage, as the case may be, corresponding to digital '1' and the logical 'low' may represent any value corresponding to digital '0'. The relative change in either of the predetermined voltage threshold or the predetermined current threshold, done to achieve the balance point may allow for the determination of relative phase difference between the voltage phase signal and the current phase signal.

The determination of the relative phase difference between the response voltage signal and the response current signal may also be repeated for different frequencies with the set of predetermined frequencies, such as for a second frequency and a third frequency. Based on the relative phase difference identified for the ink at different frequencies, the characteristics of the ink may be determined. In operation, the relative phase differences identified for different frequencies may be compared to an existing record of phase differences associated with a genuine or healthy ink, and deviation in relative phases may allow for determination of the characteristics of the ink. For the sake of explanation, genuine ink or healthy ink have been referred to inks for which the inkjet printing system has been configured to provide optimum results and, the relative phase difference for such genuine or healthy ink are treated as a reference to determine the characteristics of the ink within the inkjet printing system.

Therefore, the above described system and method may allow determining characteristics of an ink within the inkjet printing system in a cost effective manner eliminating utilization of swept sine wave generators and separate ADC converters. Also, the described systems and methods can be implemented on the print head of the inkjet printing device to allow on-the-spot detection of ink characteristics. The analysis of the characteristics of the ink at the print head also excludes any added efforts taken to port the ink, or port the ink reservoirs, from one place to another for the purpose of analysis and allows for testing of the ink health at the point of concern, that is, within the print head itself. In one example, the configuration of the inkjet printing system may also be modified based on the identified characteristics of the ink to achieve optimal results from the inkjet printing device.

The above mentioned systems and methods are further described with reference to FIG. 1 to FIG. 5. It should be noted that the description and figures merely illustrate the principles of the present subject matter along with examples described herein and, should not be construed as a limitation to the present subject matter. It is thus understood that various arrangements may be devised that, although not explicitly described or shown herein, embody the principles of the present subject matter. Moreover, all statements herein reciting principles, aspects, and specific examples thereof, are intended to encompass equivalents thereof.

FIG. 1 illustrates an inkjet printing system for analysis of the ink and determination of its characteristics. The printing environment may include an inkjet printing system 102 which may analyze characteristics of an ink 104, stored within the inkjet printing system 102 for the purpose of printing.

The inkjet printing system 102 may be preconfigured for printing onto a print medium, such as paper based on the characteristics of the ink 104 being utilized for the purpose of printing. For instance, speed of relative movement of the print medium and the print head may be determined based on ink properties, the amount of ink to be released from the nozzles may also be based on the characteristics of the ink, etc.

However, the characteristics of the ink 104 may change over a period of time either due to destabilization, or due to replacement of the ink 104 with different quality of ink. For example, in situations where the ink 104 may have been dehydrated, the print nozzles may get clogged and may not dispense any ink onto the print medium and may even cause wear and tear to the print head due to friction. Therefore, the inkjet printing system 102 analyzes the ink 104 to identify characteristics of the ink 104, from time to time.

The inkjet printing system 102 may be any of the known inkjet printing systems used for the purpose of printing on print media by use of the ink 104. For example, the inkjet printing system 102 may be a continuous inkjet printing system, a thermal Inkjet printing system, a piezoelectric inkjet printing system, or may be a drop-on-demand inkjet printing system.

Further, the inkjet printing system 102 may be utilized for analysis of different type of inks 104, including, but not limited to, water based dye inks, water based pigment inks, solvent inks, UV-curable inks, oil based pigment inks, dye sublimation inks, pigmented water based latex inks, and phase change inks.

Although the description herein is with reference to specific inkjet printing system 102 and ink 104, other inkjet printing systems 102 and inks 104 may also be utilized, albeit with a few variations. Various example implementations of the present subject matter have been described below by referring to several examples.

In one example of the present subject matter, the ink 104 is subjected to an alternating signal 106 to generate a response current signal 108-1 and a response voltage signal 108-2. For the sake of explanation, the response current signal 108-1 and the response voltage signal 108-2 have been commonly referred to as response signals 108.

In one example, the ink 104 may be subjected to a set of alternating signals 106 of different predetermined frequencies for the analysis of the response signals 108. The analysis of the ink 104 with the alternating signals 106 of different frequency may improve the accuracy of the determination of the characteristics of the ink 104. The set of alternating signals 106 of predetermined frequencies may either include fixed set frequencies for all type of inks, or may include different set of frequencies for different type of ink 104 being analyzed. For instance, in one example, the set of alternating signals 106 may include signals of frequency $\alpha$ Hertz (Hz), $\beta$Hz, $\gamma$ Hz, and $\delta$ Hz for analyzing all types of inks 104. In another example, the set of alternating signals may include different set of frequencies for different types of inks. For instance, while analyzing a water based dye ink, the set of alternating signals 106 may include a first frequency $\alpha$ Hertz (Hz), a second frequency $\beta$ Hz, and a third frequency $\gamma$ Hz, but while analyzing a water based pigment ink, the set of alternating signals 106 may merely include a first frequency $\alpha$ Hz and a second frequency $\mu$ Hz.

Each alternating signal 106 may either be an alternating current signal, or may be an alternating voltage signal. Since the amplitude of an alternating signal 106 varies with respect to time, the alternating current signal may include varying current while the alternating voltage signal may include varying voltage with respect to time.

In one example, the alternating signal 106 may be generated within the inkjet printing system 102 based on a clock signal generated by a clock 110 of the inkjet printing system 102. For instance, a master clock of the inkjet printing system 102 may be utilized for the purpose of generation of the alternating signal 106. Similarly, clock signals provided to other components of the inkjet printing system 102, such as a print head, may be utilized for the purpose of generation of the alternating signal 106.

Since the clock signals are generally square waves, the signal received from the clock 110 may be filtered by a filter 112 to generate sine wave signals, according to an example of the present subject matter. The filter 112 may include a RC low pass circuit to filter the clock signal and generate the alternating signal 106. It would be appreciated that filters other than a RC low pass filter may also be utilized for generation of the sine waves from the clock signals received from the clock 110. Since the alternating signal 106 is generated from the clock signal, use of a separate sine wave generator can be avoided for the purpose of generating the alternating signal 106.

As described above, since the ink 104 may be subjected to the multiple alternating signals 106 of different frequencies for the purpose of determination of the ink characteristics, the filter 112 may generate sine wave signals corresponding to different frequencies from the clock signal. In one example, the filter 112 may divide the clock signal to vary its frequency and accordingly generate the set of alternating signals 106 of different frequencies. For example, a clock signal of frequency 1 Kilo Hz (KHz) may be divided to generate clock signals of frequency 500 Hz and 250 Hz. Such clock signals may then be filtered by the filter 112 to generate the set of alternating signals 106 of different frequencies.

It would be appreciated that to generate the sine waves of different frequencies, apart from variation in the clock signals, the filter 112 may also be tuned accordingly. In one example, while utilizing the RC low pass filter, the value of resistance or capacitance may be varied to obtain sine wave signal of a different frequency. For example, if the filter 112 utilizes a resistor of resistance $R_1$ and a capacitor of capacitance $C_1$ to generate a signal of frequency $F_1$, the filter 112 may utilize another resistor of resistance $R_2$ and another capacitor of capacitance $C_2$ to generate the alternating signal 106 of another frequency. Similarly, the value of resistor and capacitor may be varied to generate alternating signal 106 of different frequencies. Although it has been described that the value of both, the resistance and capacitance may be varied, it would be appreciated that the variation in any of the one may also allow generation of the alternating signal 106 of different frequencies.

As described earlier, the ink 104 when subjected to the alternating signal 106 may generate response signal 108. The alternating signal 106 may either be an alternating current signal, or may be an alternating voltage signal. Therefore, if the ink 104 is subjected to an alternating current signal, the response signal 108 generated may be the response voltage signal 108-2. In such situation, the alternating current signal to which the ink is subjected to is considered to be the response current signal 108-1. Similarly, if the ink 104 is subjected to an alternating voltage signal, the response current signal 108-1 may be generated and the alternating voltage signal may be considered to be the response voltage signal 108-2.

The response signals 108 may be generated for all alternating signals within the set of alternating signals 106 of different predetermined frequencies. That is, for an alternating signal 106 of frequency $F_1$, the response signals 108 may be generated. Similarly, for another alternating signal 106 of frequency $F_2$, other response signals 108 may be generated. Therefore, if the set of alternating signals 106 includes signals of 4 different frequencies, 4 different response signals may be generated.

In one example of the present subject matter, the generated response signals 108 may be analyzed by a signal comparison unit 114. Since the alternating signal 106, subjected to the ink 104, is either an alternating current signal or an alternating voltage signal, it would be appreciated that the response voltage signal 108-2 and the response current signal 108-1 would include a relative phase difference, introduced due to the impendence of the ink 104. Therefore, the signal comparison unit 114 analyzes the response signals 108 to determine the relative phase difference between the response voltage signal 108-2 and the response current signal 108-1.

The response current signal 108-1 and the response voltage signal 108-2 may be compared to predetermined threshold values 116 by the signal comparison unit 114. In one example, the predetermined threshold values 116 may be generated by a threshold source 118, and may include a predetermined voltage threshold and a predetermined current threshold. For the sake of explanation, the predetermined voltage threshold has been referred to as predetermined voltage threshold 116-2 (not shown) and the predetermined current threshold is referred to as predetermined current threshold 116-1 (not shown). Also, the predetermined current threshold 116-1 and the predetermined voltage threshold 116-2 have been commonly referred to as the predetermined threshold values 116. In one example of the present subject matter, the threshold source 118 may be an on-die memory, such as an erasable programmable read only memory (EPROM). The utilization of on-die memory as the threshold source 118 may avoid utilization of separate source of memory, other than the inkjet printing system 102.

In one example of the present subject matter, the signal comparison unit 114 may compare the response current signal 108-1 with the predetermined current threshold 116-1 and the response voltage signal 108-2 with the predetermined voltage threshold 116-2 to determine a relative phase between the response current signal 108-1 and the response voltage signal 108-2. The signal comparison unit 114 may include analog comparing units (not shown) to compare the response current signal 108-1 with the predetermined current threshold 116-1 and the response voltage signal 108-2 with the predetermined voltage threshold 116-2. The use of analog comparing units may allow the analog response current signal 108-1 and the analog response voltage signal 108-2 to be compared without being converted to digital signals. Therefore, the use of the signal comparison unit 114 with analog comparing units may not necessitate use of an ADC.

The comparison of the response current signal 108-1 with the predetermined current threshold 116-1 may generate a current phase signal. Similarly, the comparison of the response voltage signal 108-2 with the predetermined voltage threshold 116-2 may generate a voltage phase signal. For the sake of explanation, the current phase signal and the voltage phase signal have been commonly referred to as phase signals, hereinafter. Since the phase signals are generated based comparison with the predetermined threshold values 116, change in the predetermined threshold values 116 may vary the time when either of the current phase signal or the voltage phase signal changes its phase.

Therefore, in one example of the present subject matter, a tuning module 120 may vary the predetermined threshold values 116 until a balance point is achieved. The balance point can be understood as the instance at which the voltage phase signal and the current phase signal concurrently transitions from a logical 'low' to a logical 'high'. In one example, the signal comparison unit 114 may provide a feedback signal 122 to the tuning module 120 to determine the occurrence of the balance point. The description of the components of the signal comparison unit 114 has been described with respect to FIG. 3 and therefore, the explanation of the signal comparison unit has been omitted here for the sake of brevity.

While tuning the predetermined threshold values 116, the tuning module 120 may either vary any one of the predetermined threshold values 116, or may vary both the predetermined current threshold 116-1 and the predetermined voltage threshold 116-2 to achieve the balance point. The tuning module 120 may provide the relative change performed in either of the predetermined voltage threshold 116-2 or the predetermined current threshold 116-1 to achieve the balance point, to an analysis module 124 for determination of relative phase difference between the phase signals. The analysis module 124 may compute a relative change in the predetermined threshold values 116 based on which a time difference between the phase signals may be determined. Further, based on the time difference, the analysis module 124 may determine the relative phase difference between the phase signals. It would be appreciated that the relative phase difference between the phase signals may also correspond to the relative phase difference between the response signals 108.

The determination of the relative phase difference between the response voltage signal 108-2 and the response current signal 108-1 may also be repeated for different frequencies of signal included within the set of alternate signals 106. Based on the relative phase difference identified for the ink 104 at different frequencies, ink characteristics 126 may be determined. The analysis module 124 may compare the relative phase differences identified for different frequencies to an existing record of phase differences which may correspond to a genuine or healthy ink. The analysis module 124 may analyze any deviation in the relative phase difference to identify if the ink 104 has destabilized or is a non-genuine ink.

As described earlier, the analysis of the ink 104 may be done within the inkjet printing system 102. In one example of the present subject matter, print head of the inkjet printing system 102 may implement the described components to analyze the ink 104 and determine the ink's 104 characteristics.

Figure 2:
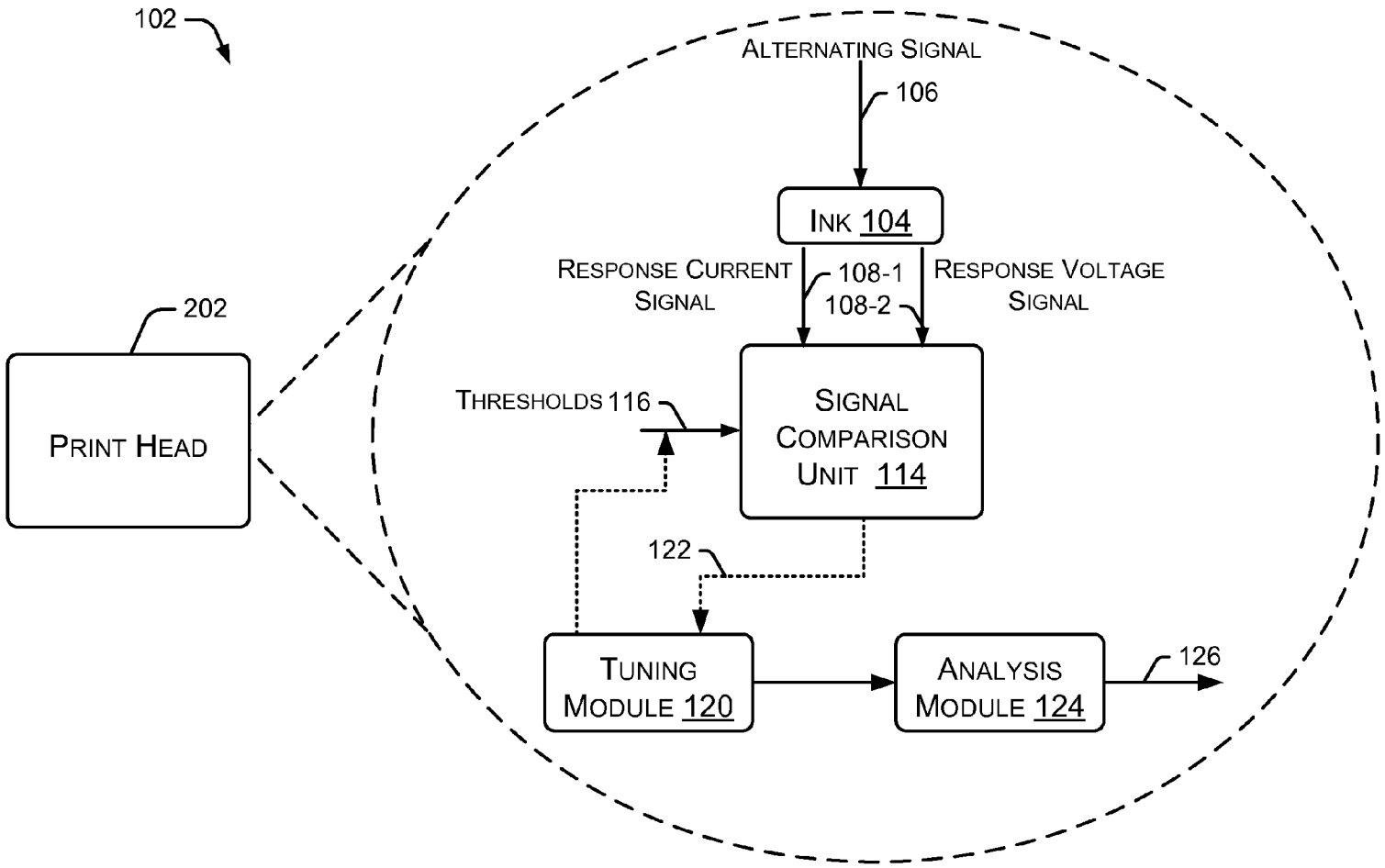
FIG. 2 illustrates a print head of an inkjet printing system for detecting ink characteristics, according to an example of the present subject matter.

FIG. 2 a print head 202. The print head 202 may analyze the ink 104 to determine the ink characteristics 126. In one example of the present subject matter, the print head 202 may receive alternate signal 106. The alternate signal 106 may be generated from clock signals of the clock 110. The clock 110 may either be a master clock of the inkjet printing system 102, or may a separate clock of the print head 202.

The ink 104 within the print head 202 may be subjected to the alternate signal 106. As described earlier, the ink 104 may generate response signals 108 which may include the response current signal 108-1 and the response voltage signal 108-2.

The response signals may be analyzed by the signal comparison unit 114 to determine the relative phase difference between the response signals 108. The signal comparison unit 114 may also be provided with predetermined threshold values 116 for the purpose of comparison. Further, based on the comparison, the signal comparison unit 114 may generate phase signals. Analysis of these phase signals may also be provided as a feedback signal 122 to the tuning module 120. The tuning module 120 may then vary the predetermined threshold values 116 to achieve the balance point. The variation done by the tuning module 120 to achieve the balance point may be provided to the analysis module 124 to determine the ink characteristics 126 corresponding to the ink 104. Although the tuning module 120 has been shown internal to the print head 202, it would be appreciated that the tuning module 120 may be placed outside the print head 202. In one example, the tuning module 120 may be included within the inkjet printing system 102, but however outside the print head 202.

In one example, based on determination of the characteristics of the ink 104, the print head 202 may determine to use the ink 104 or not. Therefore, in said example of the present subject matter, the analysis of the ink characteristics may prevent the inkjet printing system 102 from damage due to usage of destabilized ink or non-genuine ink.

Figure 3:
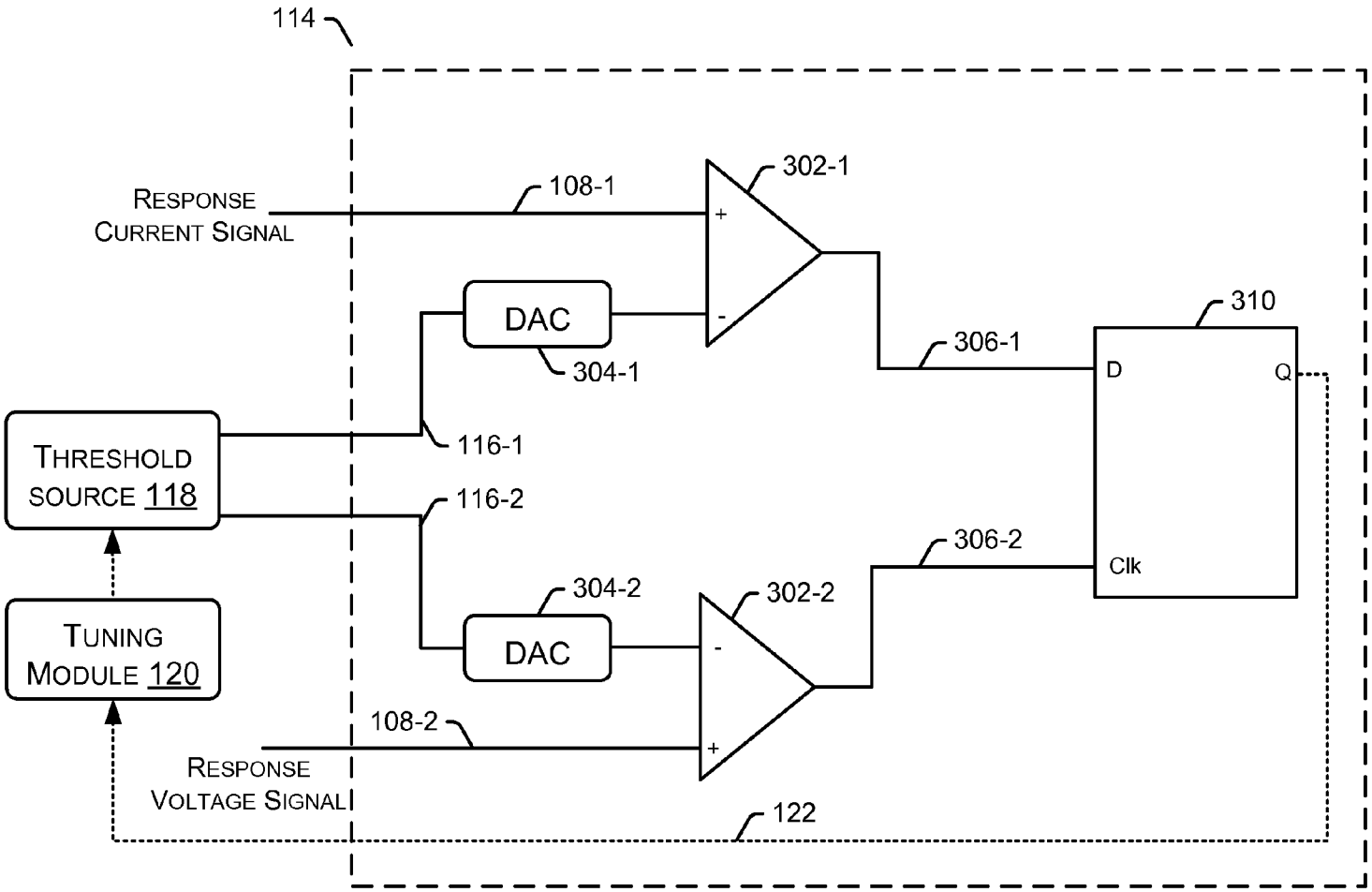
FIG. 3 illustrates a signal comparison unit of the inkjet printing system for detecting ink characteristics, according to an example of the present subject matter.

FIG. 3 illustrates a schematic of the signal comparison unit 114, according to an example of the present subject matter. The signal comparison unit 114 may analyze the response signals 108. The response current signal 108-1 and the response voltage signal 108-2 may be received as input by the signal comparison unit 114. The signal comparison unit 114 may also receive predetermined threshold values 116 from the threshold source 118.

In one example, the signal comparison unit 114 may include comparators 302-1 and 302-2 for the purpose of comparison of the response signals 108 with the predetermined threshold values 116. For the sake of explanation, the comparator comparators 302-1 and 302-2 have been referred to as comparators 302, hereinafter. The comparators 302 may compare analog input signals to generate an output signal. In the described example, the comparator 302-1 may compare the response current signal 108-1 with the predetermined current threshold 116-1. Similarly, the comparator 302-2 may compare the response voltage signal 108-2 with the predetermined voltage threshold 116-2.

Since the comparators 302 compare analog signals, the predetermined threshold values 116 generated by the threshold source 118 may be converted from digital signals to analog signals by digital to analog convertors (DACs) 304-1 and 304-2. The DACs 304-1 and 304-2 have been collectively referred to as DAC 304, hereinafter. As described earlier, the threshold source 118 may be an on-die memory storing the predetermined threshold values 116. Therefore, the DACs 304 may convert the digital predetermined threshold values 116 to analog predetermined threshold values 116.

In another example implementation of the present subject matter, the signal comparison unit 114 may include single comparator 302 instead of two different comparators 302-1 and 302-2. In such an example implementation, the single comparator 302 may be time multiplexed to compare the response current signal 108-1 with the predetermined current threshold 116-1 and the response voltage signal 108-2 with the predetermined voltage threshold 116-2. The use of single comparator 304 may further reduce the space utilization of the signal comparison unit 114.

Similarly, the signal comparison unit 114 may also include a single DAC 304 instead of utilization of the two DAC 304-1 and the DAC 304-2. The single DAC 304 may be time multiplexed to convert the digital predetermined threshold values 116 to analog predetermined threshold values 116. In one example, the signal comparison unit 114 may also utilize existing DACs of the inkjet printing system 102, such as the DAC of temperature control units, to save the utilization of hardware space.

The comparator 302, upon comparing the response signals 108 with the predetermined threshold values 116, may generate the phase signals. The comparator 302-1 may generate a current phase signal 306-1 and the comparator 302-2 may generate a voltage phase signal 306-2. For the ease of explanation, the current phase signal 306-1 and the voltage phase signal 306-2 have been commonly referred to as phase signals 306, hereinafter. Since the comparators 302 generate the phase signals 306 based on comparison of the response signals 108 with the predetermined threshold values 116, the generated phase signals 306 would also be alternating signals changing phase from time to time.

In one example of the present subject matter, the predetermined threshold values 116 may be set such that either of the current phase signal and the voltage phase signal changes phase to logical 'high' before the another. It would be appreciated that the logical 'high' may represent any value of the current phase signal or the voltage phase signal corresponding to digital '1' and the logical 'low' may represent any value corresponding to digital '0'.

To determine the balance point where the voltage phase signal and the current phase signal concurrently transitions from a logical 'low' to a logical 'high', the signal comparison unit 114 may include a D flip-flop 310. The D flip-flop 310 may take the phase signals 306 as inputs and may generate the feedback signal 122 as the output. The output of the D flip-flop may change when the input signals, the current phase signal 306-1 and the voltage phase signal 306-2 may concurrently change phases. Therefore, based on the feedback signal 122, the tuning module 120 may vary the predetermined threshold values 116.

Figure 4:
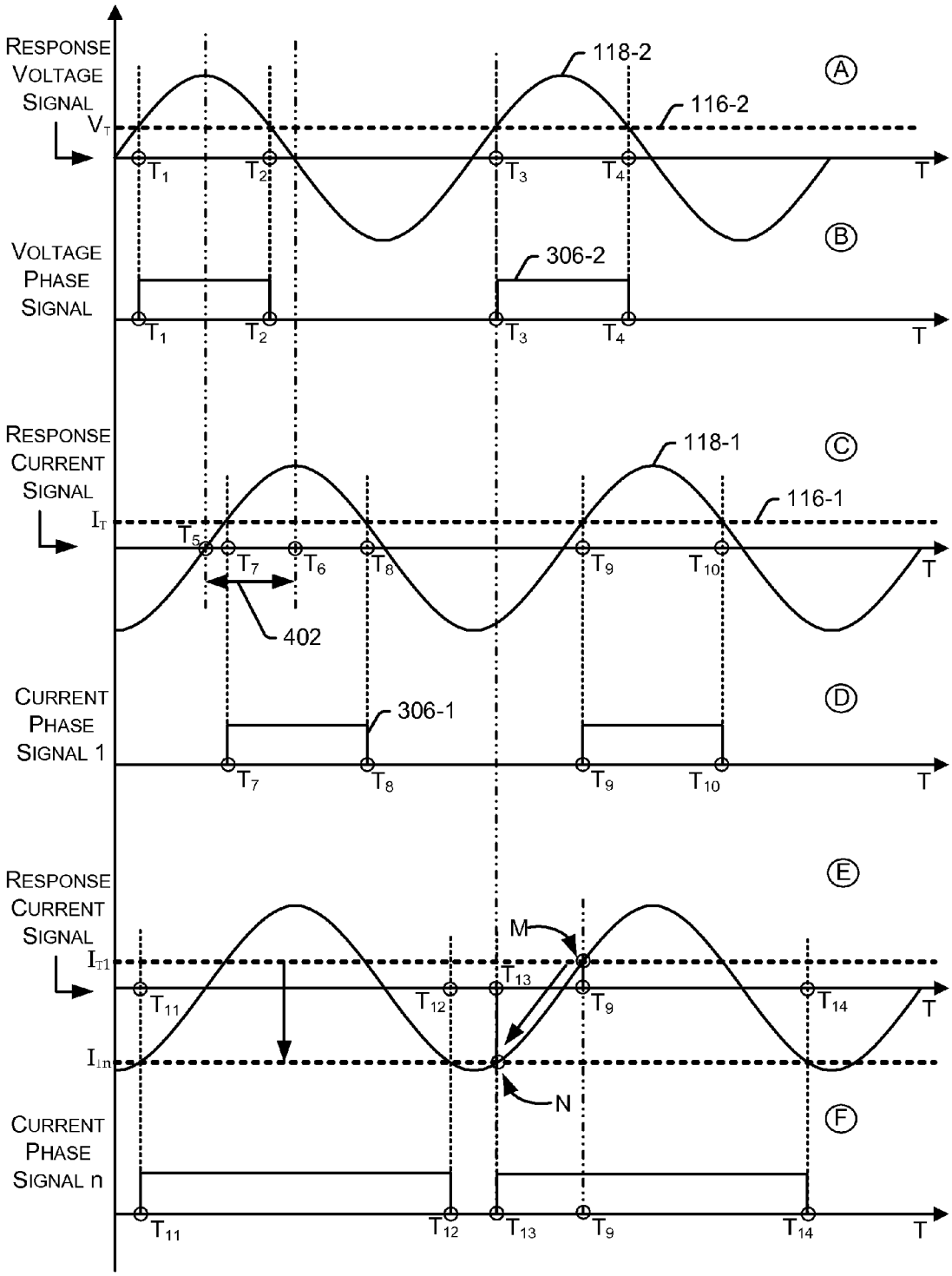
FIG. 4 graphically illustrates detection of a relative phase difference for detecting ink characteristics, according to an example of the present subject matter.

The change in phase of the current phase signal 306-1 and the voltage phase signal 306-2, along with determination of the relative phase difference between the phase signals has been explained in detail with respect to FIG. 4.

FIG. 4 graphically illustrates the signal analysis for detection of a relative phase difference between the response signals 108, or the phase signals 306. Different graphs including 'A', 'B', 'C', 'D', 'E', and 'F' represent different signals where the 'X' axis of the graphs represents time while the 'Y' axis of the graphs represent amplitude of the represented signal. It would be appreciated that for voltage signals, the amplitude represents voltage and for current signals, the amplitude represents current. Graph 'A' and graph 'C' represent the response voltage signal 118-2 and the response current signal 118-1, respectively. The predetermined voltage threshold 116-2 applied to the response voltage signal 118-2 is depicted with $V_T$ and the predetermined current threshold 116-1 applied to the response current signal 118-1 is depicted by $I_T$.

In one example of the present subject matter, the response current signal 118-1 and the response voltage signal 118-2 are sine wave signals. Due to the impedance of the ink 104, the depicted response voltage signal 118-2 and the response current signal 118-1 include a phase difference. It would be appreciated that the phase difference can be corresponded to a time difference 402 between the two response signals 108.

The graphs 'B' and 'D' represent the voltage phase signal 306-2 and the current phase signal 306-1, respectively. As described earlier, the voltage phase signal 306-2 is generated when the response voltage signal 118-2 is compared with the predefined voltage threshold 116-2 ($V_T$), and the current phase signal 306-1 is generated when the response current signal 118-1 is compared with the predefined current threshold 116-1 ($I_T$).

In graph 'A', it could be identified that the response voltage signal 118-2 is greater than the $V_T$ during the time periods $T_1$ to $T_2$ and $T_3$ to $T_4$. Correspondingly, it could be identified in the graph 'B' that the voltage phase signal 306-2 is 'high' between the time periods $T_1$ to $T_2$ and $T_3$ to $T_4$.

Similarly, in graph 'C', it could be identified that the response current signal 118-1 is greater than the $I_T$ during the time periods $T_7$ to $T_8$ and $T_9$ to $T_{10}$. Correspondingly, it could be identified in the graph 'D' that the current phase signal 306-1 is 'high' between the time periods $T_7$ to $T_8$ and $T_9$ to $T_{10}$.

Since the phase difference between the response voltage signal 118-2 and the response current signal 118-1 may be corresponded to time 402, the time period from T5 to T6 may be identified by tuning the predefined threshold values 116.

In one example, the predefined voltage threshold 116-2 may be kept constant while the predefined current threshold 116-1 may be varied till the balance point is achieved. Therefore, the predefined current threshold 116-1 may be varied from $I_{T1}$ to $I_{Tn}$, as depicted in graph 'E'.

As depicted in graph 'E', when the predefined current threshold 116-1 is varied from $I_{T1}$ to $I_{Tn}$, the response current signal 118-1 is greater that the $I_{Tn}$ during the time periods $T_{11}$ to $T_{12}$ and $T_{13}$ to $T_{14}$. Correspondingly, it could be identified in the graph 'F' that the new current phase signal 306-1 is 'high' between the time periods $T_{11}$ to $T_{12}$ and $T_{13}$ to $T_{14}$.

When the predefined current threshold 116-1 is varied up to $I_{Tn}$, it could be identified that the voltage phase signal 306-2 and the current phase signal 306-1 change phases concurrently. In graph 'B' and graph 'F', it could be observed that the T13 is equal to T3 and at this time instance, the voltage phase signal 306-2 and the current phase signal 306-1 change phase concurrently. Therefore, when the predefined current threshold 116-1 is varied to $I_{Tn}$, the balance point may be achieved.

The variation in the predefined current threshold 116-1 may lead to change in the time period when the current phase signal 306-1 changes its phase from 'Low' to 'High'. For example, when the predefined current threshold 116-1 was set at $I_T$, the current phase signal 306-1 would change from 'Low' to 'High' at time $T_9$ when at point 'M' the response voltage signal 108-2 is greater than $I_T$. Due to the variation in the predefined current threshold 116-1, the time at which the current phase signal 306-1 would change from 'Low' to 'High' may change to $T_{13}$ when at point 'N' the response voltage signal 108-2 is greater than $I_{Tn}$. Therefore, the change in the time period necessitated to achieve the balance point, could be understood to be from $T_9$ to $T_{13}$.

The time period $T_{13}$ to $T_9$ would be similar to the time period $T_5$ to $T_6$ and may correspond to the relative phase difference between the response current signal 108-1 and the response voltage signal 108-2.

Figure 5:
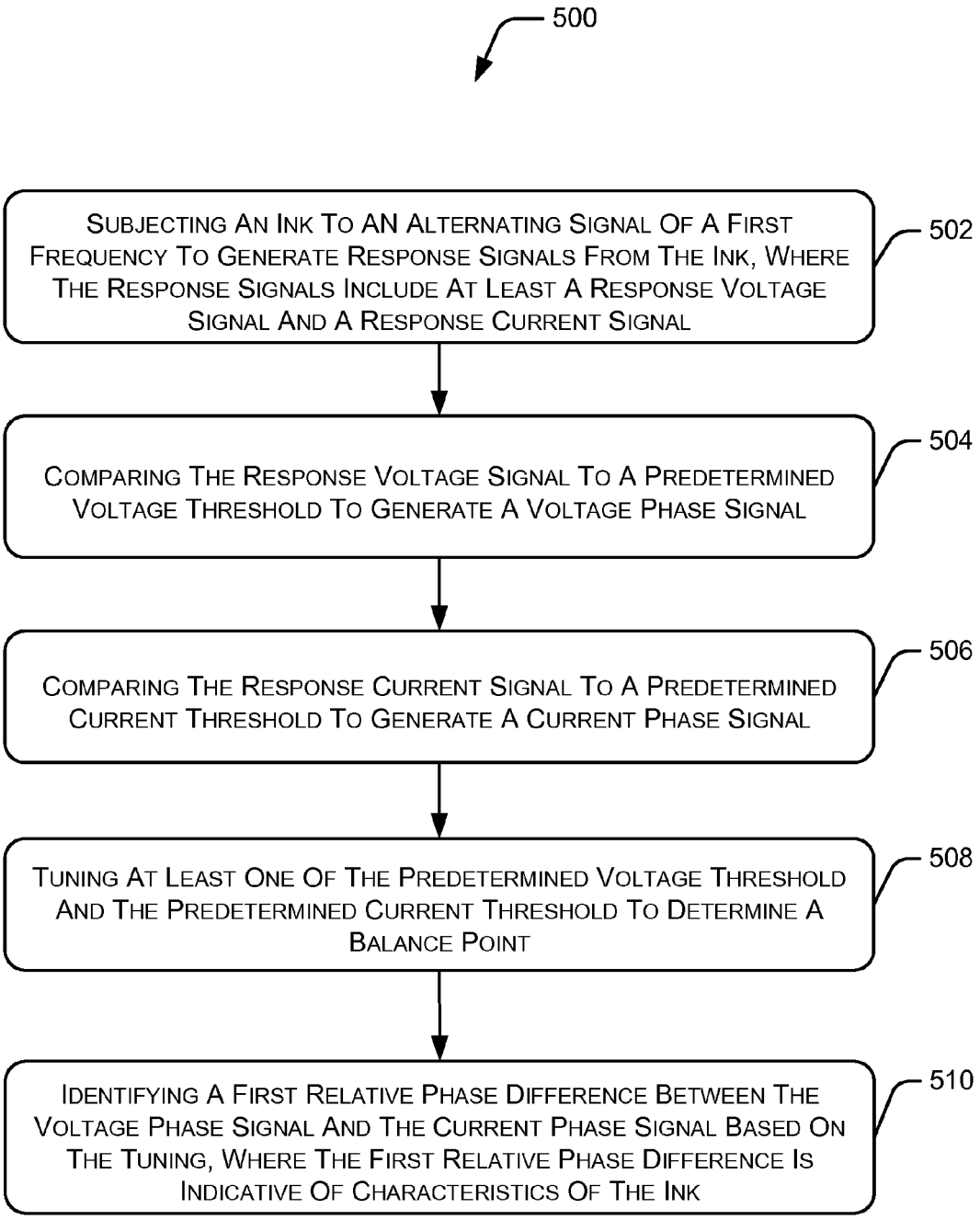
FIG. 5 illustrates a method for detecting ink characteristics, according to an example of the present subject matter.

FIG. 5 illustrates a method 500 for detecting ink characteristics, according to an example of the present subject matter. The order in which the method 500 is described is not intended to be construed as a limitation, and any number of the described method blocks may be combined in any order to implement the method 500, or an alternative method. Furthermore, the method 500 may be implemented by inkjet printing system(s) through any suitable hardware components, non-transitory machine readable instructions, or combination thereof.

It may be understood that steps of the method 500 may be performed by programmed inkjet printing systems. The steps of the methods 500 may be executed based on instructions stored in a non-transitory computer readable medium, as will be readily understood. The non-transitory computer readable medium may include, for example, digital memories, magnetic storage media, such as one or more magnetic disks and magnetic tapes, hard drives, or optically readable digital data storage media.

Further, although the method 500 may be implemented in a variety of printing systems; in an example described in FIG. 5, the method 500 is explained in context of the aforementioned inkjet printing system 102.

Referring to FIG. 5, in an example of the present subject matter, at block 502, ink of the inkjet printing system 102 is subjected to an alternating signal of a first frequency to generate response signals from the ink. The response signals may include at least a response voltage signal and a response current signal. In one example, the alternating signal may be generated based on a clock signal of the inkjet printing system 102.

At block 504, the response voltage signal may be compared to a predetermined voltage threshold to generate a voltage phase signal. The comparison may be undertaken by an analog comparator, such as the signal comparison unit 114.

At block 506, the response current signal may be compared to a predetermined current threshold to generate a current phase signal. The comparison may either be undertaken by the analog comparator utilized for the comparison of the response voltage signal, or may be undertaken by a separate analog comparator.

At block 508, at least one of the predetermined voltage threshold and the predetermined current threshold may be tuned to determine a balance point. The balance point can be understood as the time at which the voltage phase signal and the current phase signal concurrently transitions from a logical 'low' to a logical 'high'. The tuning of the predetermined threshold values may include relative variation of the predetermined threshold values to generate the phase signals. Further, the determination of the balance point may be identified by a D flip-flop.

At block 510, a first relative phase difference between the voltage phase signal and the current phase signal may be identified based on the tuning. The time difference identified in the change in phase of the phase signal corresponding to the variation in the predetermined threshold values may correspond to the relative phase difference between the response signals. Therefore, upon identification of relative phase difference between the response signals, the identified relative phase difference may be compared to an existing record of phase differences corresponding to genuine or healthy inks for determination of characteristics of the ink.

Although examples and implementations of present subject matter have been described in language specific to structural features and/or methods, it is to be understood that the present subject matter is not necessarily limited to the specific features or methods described. Rather, the specific features and methods are disclosed and explained in the context of a few example implementations for inkjet printing systems.

What is claimed is:

1. A method for determining characteristics of an ink in an inkjet printing system, the method comprising:

subjecting the ink to an alternating signal of a first frequency to generate response signals from the ink, wherein the alternating signal is one of an alternating current signal and an alternating voltage signal, and wherein the response signals include at least a response voltage signal and a response current signal, the alternating signal being generated based on a clock signal of the inkjet printing system;

comparing the response voltage signal to a predetermined voltage threshold, to generate a voltage phase signal;

comparing the response current signal to a predetermined current threshold, to generate a current phase signal;

tuning at least one of the predetermined voltage threshold and the predetermined current threshold to determine a balance point, wherein the balance point is indicative of concurrent transition of the voltage phase signal and the current phase signal from a logical 'low' to a logical 'high'; and identifying a first relative phase difference between the voltage phase signal and the current phase signal based on the tuning, wherein the first relative phase difference is indicative of the characteristics of the ink corresponding to the first frequency.

2. The method as claimed in claim 1, wherein the identifying comprises determining a relative change in at least one of the predetermined voltage threshold and the predetermined current threshold to achieve the balance point, wherein a time period corresponding to the relative change is indicative of the first relative phase difference.

3. The method as claimed in claim 1, wherein the method further comprises comparing the identified first relative phase difference to an existing record of relative phase differences to determine the characteristics of the ink.

4. The method as claimed in claim 1, wherein the method further comprises:

subjecting the ink to another alternating signal of a second frequency;

identifying second relative phase difference corresponding to the another alternating signal of the second frequency; and comparing the first relative phase difference and the second relative phase difference to an existing record of relative phase differences to determine the characteristics of the ink.

5. The method as claimed in claim 1, wherein the predetermined voltage threshold and the predetermined current threshold are provided as analog values for the comparing.

6. A print head of an inkjet printing system comprising:

a signal comparison unit to:

receive response signals generated by an ink of the inkjet printing system when subjected to an alternating signal of a first frequency, wherein the alternating signal is one of an alternating current signal and an alternating voltage signal, and wherein the response signals include at least a response voltage signal and a response current signal;

compare the response voltage signal to a predetermined voltage threshold, to generate a voltage phase signal; and compare the response current signal to a predetermined current threshold, to generate a current phase signal; and a tuning module to tune at least one of the predetermined voltage threshold and the predetermined current threshold to determine a balance point, wherein the balance point is indicative of concurrent transition of the voltage phase signal and the current phase signal from a logical 'low' to a logical 'high'.

7. The print head as claimed in claim 6 further comprising an analysis module to:

determine a relative change in at least one of the predetermined voltage threshold and the predetermined current threshold to achieve the balance point;

identify a first relative phase difference between the voltage phase signal and the current phase signal based on a time period corresponding to the relative change; and comparing the identified first relative phase difference to an existing record of relative phase differences to determine the characteristics of the ink corresponding to the first frequency.

8. The print head as claimed in claim 6, wherein the signal comparison unit includes at least one analog comparator to compare the response voltage signal and the response current signal.

9. The print head as claimed in claim 6, wherein the signal comparison unit includes a digital to analog convertor (DAC) to convert the predetermined voltage threshold and the predetermined current threshold to analog values, wherein the DAC is time multiplexed to convert the predetermined voltage threshold and the predetermined current threshold to analog values.

10. An inkjet printing system for detecting ink characteristics, the inkjet printing system comprising:

a clock to provide clock signals;

a filter coupled to the clock to:

generate a set of alternating signals each having a different frequency, and being one of an alternating current signal and an alternating voltage signal; and apply each alternating signal from amongst the set of alternating signals to ink of the inkjet printing system to generate response signals corresponding to each alternating signal, wherein the response signals corresponding to each alternating signal include at least a response voltage signal and a response current signal;

a signal comparison unit coupled to the filter to:

compare the response voltage signal corresponding to each alternate signal, to a predetermined voltage threshold to generate a voltage phase signal, wherein the predetermined voltage threshold is received from a threshold source; and compare the response current signal, corresponding to each alternate signal, to a predetermined current threshold, to generate a current phase signal;

a tuning module coupled to the signal comparison unit to tune at least one of the predetermined voltage threshold and the predetermined current threshold to determine a balance point corresponding response signals generated for each alternate signal, wherein the balance point is indicative of concurrent transition of the voltage phase signal and the current phase signal from a logical 'low' to a logical 'high'; and an analysis module coupled to the tuning module to:

identify a relative phase difference, corresponding to each alternating signal, between the voltage phase signal and the current phase signal based on the tuning; and compare the identified relative phase difference, corresponding to each alternating signal, to an existing record of relative phase differences to determine the characteristics of the ink at different frequencies.

11. The inkjet printing system as claimed in claim 10, wherein the signal comparison unit includes a comparator to compare the response voltage signal and the response current signal, and wherein the comparator is time multiplexed for the comparing of the response voltage signal and the response current signal.

12. The inkjet printing system as claimed in claim 10, wherein the signal comparison unit includes at least one digital to analog convertor (DAC) to convert the predetermined voltage threshold and the predetermined current threshold to analog values.

13. The inkjet printing system as claimed in claim 10, wherein the analysis module determines a relative change in at least one of the predetermined voltage threshold and the predetermined current threshold to achieve the balance point, wherein a time period corresponding to the relative change is indicative of the relative phase difference, corresponding to each alternating signal.

14. The inkjet printing system as claimed in claim 10, wherein the signal comparison unit includes a D flip-flop for the determination of the balance point, wherein the voltage phase signal and the current phase signal, corresponding to each alternating signal, are provided as inputs to the D flip-flop.

15. The inkjet printing system as claimed in claim 14, wherein the balance point is determined at a flip in the output of the D flip-flop.

* * * * *